US007290922B2

(12) United States Patent
Scalfi

(10) Patent No.: US 7,290,922 B2
(45) Date of Patent: Nov. 6, 2007

(54) COUPLING FOR THE MECHANICAL AND ELECTRICAL CONNECTION OF LIGHTING DEVICES

(75) Inventor: Gianbattista Scalfi, Bovezzo (IT)

(73) Assignee: Flos S.p.A. (IT)

( * ) Notice: Subject to any disclaimer, the term of this patent is extended or adjusted under 35 U.S.C. 154(b) by 293 days.

(21) Appl. No.: 10/510,847

(22) PCT Filed: Apr. 8, 2003

(86) PCT No.: PCT/IT03/00217

§ 371 (c)(1),
(2), (4) Date: Oct. 7, 2004

(87) PCT Pub. No.: WO03/088429

PCT Pub. Date: Oct. 23, 2003

(65) Prior Publication Data

US 2005/0130502 A1 Jun. 16, 2005

(30) Foreign Application Priority Data

Oct. 23, 2003 (IT) ..... BS2002U0043

(51) Int. Cl.
*H01R 33/00* (2006.01)

(52) U.S. Cl. ..... 362/647; 362/147; 362/404; 439/226; 439/638

(58) Field of Classification Search ..... 362/147, 362/238, 240, 404, 647; 439/638, 654, 928, 439/218, 226

See application file for complete search history.

(56) References Cited

U.S. PATENT DOCUMENTS

| | | | | |
|---|---|---|---|---|
| 4,532,579 | A * | 7/1985 | Merryman | 362/239 |
| 4,631,647 | A * | 12/1986 | Ranney | 362/147 |
| 6,019,486 | A * | 2/2000 | Stewart, Jr. | 362/362 |
| 6,503,099 | B2 * | 1/2003 | Kerr, Jr. | 439/537 |

FOREIGN PATENT DOCUMENTS

| | | |
|---|---|---|
| DE | 2 210 830 | 9/1973 |
| EP | 0 676 834 | 10/1995 |

* cited by examiner

*Primary Examiner*—John Anthony Ward
(74) *Attorney, Agent, or Firm*—McGlew & Tuttle P.C.

(57) ABSTRACT

The invention relates to a coupling member for the mechanical and electrical connection of lighting device in line and/or angled for the formation of lighting system. The coupling includes a junction body (11) having more sides and on each side mechanical connecting means (18) and an electrical end connector (16), which link up with complementary elements, both mechanical (23) and electrical (21), at the edges of each lighting device (19) to be connected. The junction body bears four sides and the electrical connector along the sides are precableable.

7 Claims, 3 Drawing Sheets

COUPLING FOR THE MECHANICAL AND ELECTRICAL CONNECTION OF LIGHTING DEVICES

FIELD OF THE INVENTION

The present invention relates to lighting devices and refers in particular to an connection element for adjoining lighting devices designed for the composition of hanging lighting systems.

PRIOR ART

Lighting systems are usually produced connecting more lighting devices in line and/or angled following the requested course. The connection must be both physical, mechanical, and electrical for the continuity of the lighting bodies. Usually, for such a connection are used straight elements, at angle, T-shaped, etc. Therefore, many connection elements different according to the request, will have be constructed, with relative increase of cost of fulfillment and management of the same elements and more labour and discomfort in carrying out the required connections.

OBJECT AND SUMMARY OF THE INVENTION

One of the objects of the present invention is to provide a connecting element able to eliminate the disadvantages of the well-known technique and to allow, with the same element, a mechanical and electrical link of two, three or four devices, selectively.

Another object of the invention is to provide a modular connection element having four mechanical and electrical connection systems on the same number of sides, employable according to the needs and disguiseable when not in use.

A further object of the invention is to provide a connecting element able to simplify the connection of lighting devices, whether in line, or angled, without having to dispose of special tools, only using a screwdriver for mechanical fixing.

The above-mentioned objects and the implicit advantages that follow, are achieved, in accordance with the invention by a coupling member for connecting more lighting devices in line and/or angled to construct lighting systems, which incorporates a substantial square body and, on each side of said body, connecting mechanical means and an electrical end connector, said mechanical means and electrical connector connecting with complementary means provided at the ends of each lighting device: to connect.

The coupling member may also have a body fillet shaped, designed to interpose between two lighting devices dispose in line and with the passage of mechanical means and the electrical connector to link the same devices.

BRIEF DESCRIPTION OF THE INVENTION

Further details of the invention will result however evident by the following description made with reference to the enclosed drawings, indicative and not restrictive, in which.

DETAILED DESCRIPTION OF THE INVENTION

Figure 1:
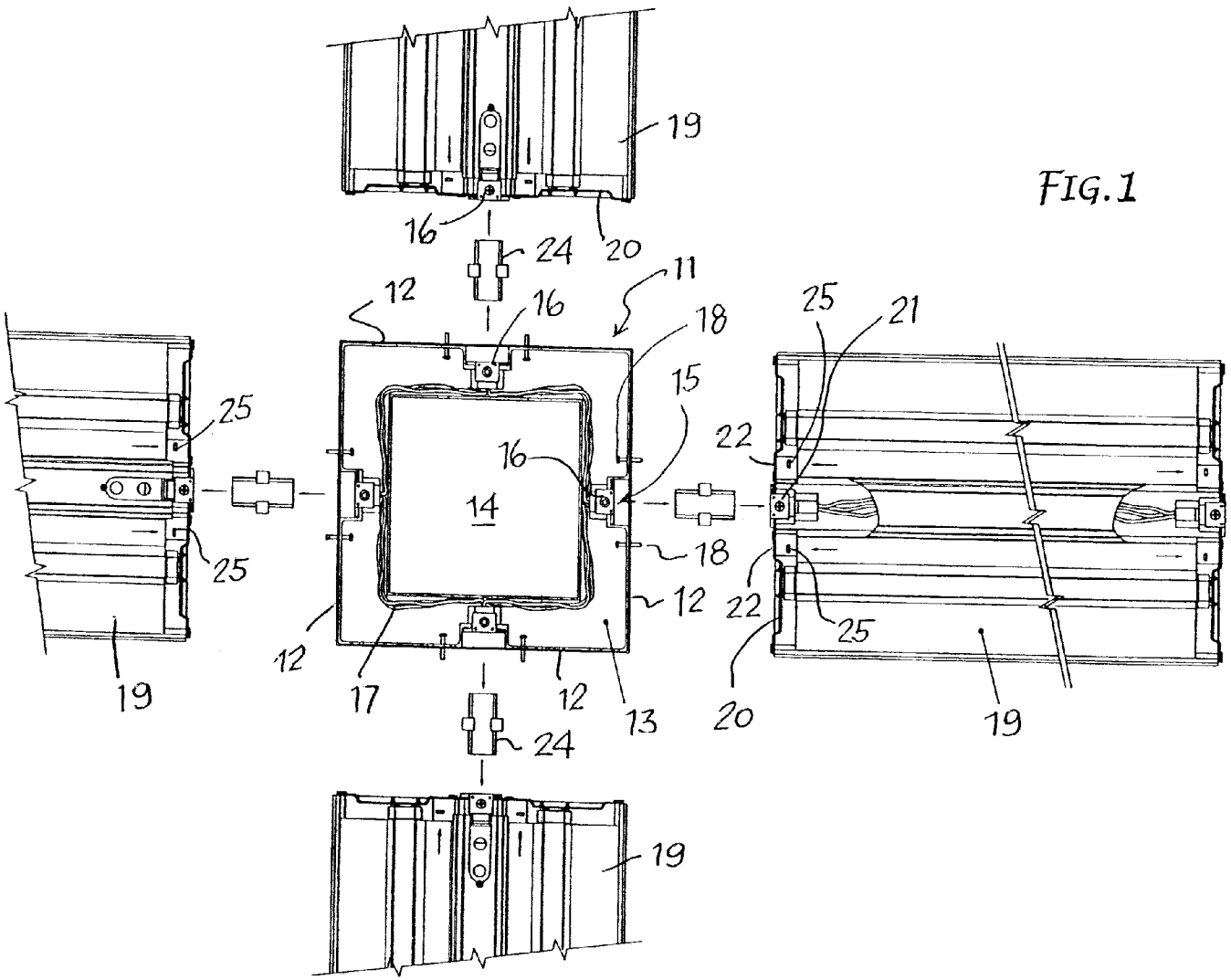
FIG. 1 shows a plan view of the connecting coupling and around it, lighting devices that can be connected, both mechanically and electrically.

The connecting coupling as shown in FIG. 1, incorporates a connecting body 11 having four square sides 12 which project from a base 13, in which an opening 14 is provided centraly, even if not necessarily.

Along each side 12 of said body a recess 15 is provided in which an electrical end connector 16, exposed and accessible sideways, is arranged and restrained. The electrical connectors 16 on the sides 12 of the body 11 are originally precabled, that is connected among each other through electrical cables 17, according to the need.

On each side 12 of the body 11, on opposite side of the recess 15 that houses the electrical end connectors 6 at least two holes are obtained in order to allow the passage of the same number of the fixing screws 18.

Each lighting device 19 to be connected with others by the above-mentioned connecting coupling, is provided in each end with a terminal breast band 20 bearing a electrical connector 21 similar to the one placed on the body 11 of the coupling and at least two holes 22 located on both opposite sides of said electrical connector 21.

As shown, the electrical connector 21 on the lighting device 19 is placed in front and lined with the electrical connector 16 on one of facing sides 12 of the body 11; in the same way the holes 22 in the terminal breast band 20 coincide with the holes on the same side 12 of the body 11.

Therefore, the junction body 11 can be used to connect, in the same way, two, three or four lighting devices 19 in line, angled, T-shaped or cross-shaped according to the need, that is in accordance with the course of the lighting system to produce.

For the electrical connection the facing end connector 16, 21 must be coupled through an intermediate electrical connector 24, that is complementary. Then the mechanical fixing is made by the screws 18, that are to be lodged in the coincident holes 22 of the adjacent sides of the body 11 and of the lighting device 19 and that are to be screwed in the corresponding nuts 25, which in the represented example are situated inside the terminal breast band of the lighting device.

Figure 3:
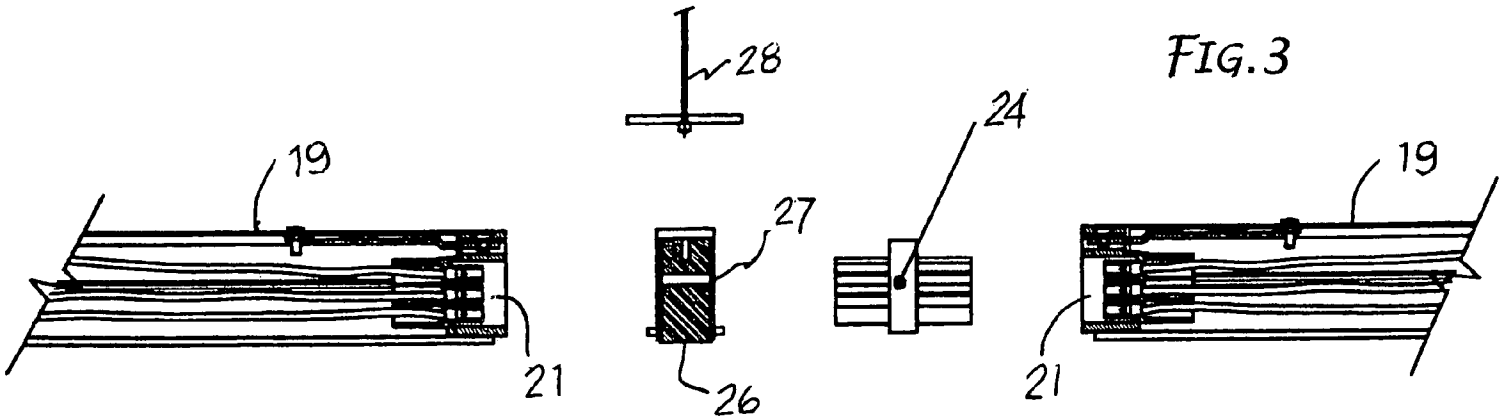
FIG. 3 shows a side view in section, magnified, of the coupling member in FIG. 2.
Figure 2:
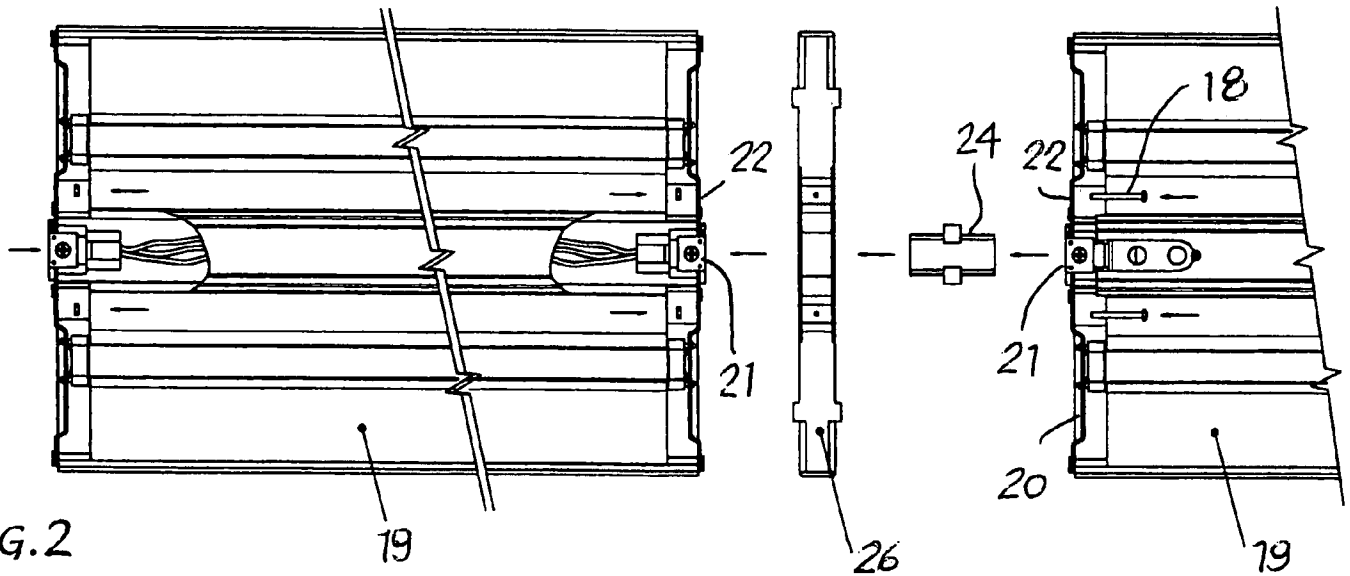
FIG. 2 shows, also in plan view, a variation of the coupling designed for a mechanical and electrical connection for only two devices in line.
Figure 4:
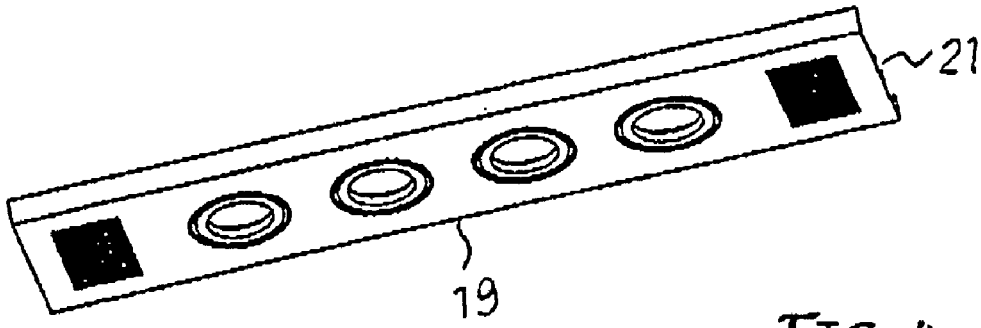
FIG. 4 is an example of lighting device from below; end
Figure 5:
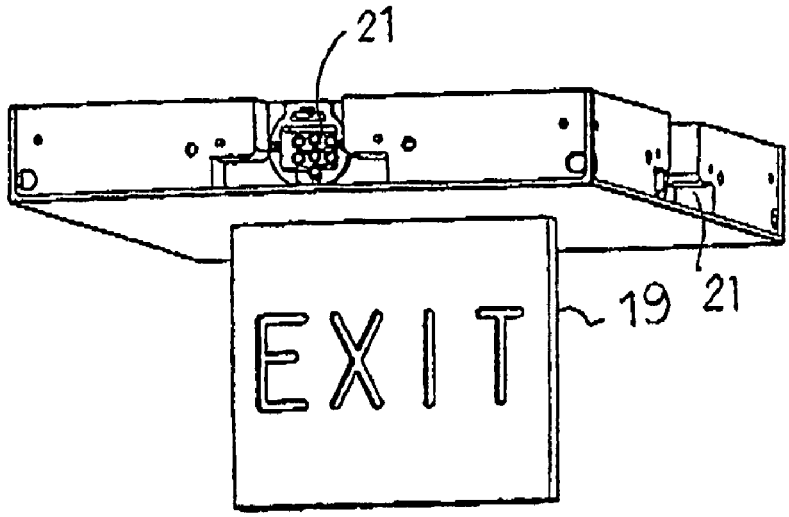
FIG. 5 is another type of device to be connected.

In the variation in FIGS. 2 and 3, the coupling body is shown in the shape of a fillet 26 that interposes between two lighting devices in line 19 each one provided, likewise what has been mentioned above, with a terminal breast band 20 bearing an electrical end connector 21 and at least two holes 22. With this arrangement, the fillet has some holes 27 for the screws 18 that fix the devices among each other and at least a recess in which the intermediate electrical connector 24 passes. A suspension cable 28 can also be fixed to the fillet.

The invention claimed is:

1. A coupling member for a mechanical and electrical connection of lighting devices, the coupling member comprising:

a junction body having plural sides;

mechanical junction means located on each side of said junction body for coupling said junction body to a complementary mechanical junction means located at an end of a lighting device;

an intermediate electrical connection element for electrically coupling said junction body to the lighting device; and an electrical end connector located on each side of said junction body, said electrical end connector having an electrical contact associated with a recess for receiving said intermediate electrical connection element, said electrical end connector being located between said mechanical junction means, each lighting device comprising a terminal breast band having an electrical connector and at least two holes on lateral sides of said electrical connector, wherein the electrical end connector on one side of the junction body is lined up with the electrical connector on the terminal breast band of the lighting device, and said lined up connectors are connected via said intermediate electrical connector, wherein the holes on one side of the junction body coincide with the holes of the terminal breast band of said lighting device and lodge screws fix the junction body to the lighting device.

2. A lighting system comprising:

screws;

an intermediate electrical connection element;

mechanically and electrically connectable lighting devices, each lighting device comprising a terminal breast band and a first electrical end connector and at least two holes on opposite sides of said first electrical connector;

a coupling member having a connecting body defined by four square sides, said coupling member having a second electrical end connector arranged and fixed along each side and said coupling member having at least two holes on opposite sides of said second electrical connector on each side, said second electrical end connectors being electrically pre-connected, said second electrical connector being lined up with said first electrical connector, said intermediate electrical connector linking said first connector and said second connector, the holes of one side of said coupling member coinciding with the holes in the terminal breast band of said lighting device, said coinciding holes receiving said screws, said screws connecting said lighting device and said coupling member.

3. A lighting system comprising:

fasteners;

an intermediate electrical connection element;

a lighting device comprising a terminal end breast band, a device electrical end connector located between at least two device fastening locations defined by said lighting device; and a junction body having plural sides, each side of said junction body having a body electrical end connector arranged between at least two body fastening locations, said body electrical end connector being disposed opposite said device electrical end connector such that said device fastening locations coincide with said body fastening locations, said intermediate electrical connection element electrically connecting said device end connector to said body end connector, said fasteners passing through said body fastening locations and said device fastening locations to mechanically connect said junction body to said lighting device.

4. A lighting system according to claim 3, wherein one side of said junction body is perpendicular to another side of said junction body.

5. A lighting system according to claim 3, wherein one body electrical end connector on one side of said junction body is electrically connected to another body electrical end connector on another side of said junction body.

6. A coupling member for a mechanical and electrical connection of lighting devices, the coupling member comprising:

a junction body having plural sides;

mechanical junction means located on each side of said junction body for coupling said junction body to a complementary mechanical junction means located at an end of a lighting device;

an intermediate electrical connection element for electrically coupling said junction body to the lighting device; and an electrical end connector located on each side of said junction body, said electrical end connector having an electrical contact associated with a recess for receiving said intermediate electrical connection element, said electrical end connector being located between said mechanical junction means, said mechanical junction means comprising at least two holes on the opposite side of said electrical end connector, on each side of said junction body, each lighting device comprising a terminal breast band having an electrical connector and at least two holes on lateral sides of said electrical connector, wherein the electrical end connector on one side of the junction body is aligned with the electrical connector on the terminal breast band of the lighting device, and said aligned connectors are connected via said intermediate electrical connector, wherein the holes on one side of the junction body mate with the holes of the terminal breast band of said lighting device and lodge screws mechanically connect the junction body and the lighting device.

7. A coupling member for a mechanical and electrical connection of lighting devices, the coupling member comprising:

a junction body having plural sides;

mechanical junction means located on each side of said junction body for coupling said junction body to a complementary mechanical junction means located at an end of a lighting device;

an intermediate electrical connection element for electrically coupling said junction body to the lighting device; and an electrical end connector located on each side of said junction body, said electrical end connector having an electrical contact associated with a recess for receiving said intermediate electrical connection element, said electrical end connector being located between said mechanical junction means, each electrical end connector being electrically preconnected, each lighting device comprising a terminal breast band having an electrical connector and at least two holes on lateral sides of said electrical connector, wherein the electrical end connector on one side of the junction body is aligned with the electrical connector on the terminal breast band of the lighting device, and said aligned connectors are connected through said intermediate electrical connector, wherein the holes on one side of the junction body coincide with the holes of the terminal breast band of said lighting device and lodge mechanically fix the junction body to the lighting device.

* * * * *